US005117241A

United States Patent [19]

Stephenson

[11] Patent Number: 5,117,241

[45] Date of Patent: May 26, 1992

[54] THERMAL PRINTING APPARATUS WITH TENSIONLESS DONOR WEB DURING PRINTING

[75] Inventor: Stanley W. Stephenson, Spencerport, N.Y.

[73] Assignee: Eastman Kodak Company, Rochester, N.Y.

[21] Appl. No.: 504,445

[22] Filed: Apr. 4, 1990

[51] Int. Cl.[5] ..... B41J 17/06; B41J 2/325

[52] U.S. Cl. ..... 346/1.1; 346/76 PH; 400/120; 400/232; 400/225; 400/224.2

[58] Field of Search ..... 346/76 PH, 1.1; 400/120, 232, 192, 225, 224.2

[56] References Cited

U.S. PATENT DOCUMENTS 4,462,656 2/1987 Shibuya et al. ..... 346/76 PH
4,712,113 12/1987 Brooks et al. ..... 346/76 PH
4,815,870 3/1989 Sparir et al. ..... 400/120

FOREIGN PATENT DOCUMENTS 0064878 4/1985 Japan ..... 340/76 PH
0232988 11/1985 Japan ..... 400/232

*Primary Examiner*—Benjamin R. Fuller
*Assistant Examiner*—Huan Tran
*Attorney, Agent, or Firm*—John L. James

[57] ABSTRACT

Thermal printing apparatus includes motor control means for variably controlling the rotational speed of a take-up spool used to wind-up an expended dye-bearing donor web after passage through a print zone. During a printing step in which the donor web is contacted by a thermal print head, the take-up spool is rotated at a relatively slow speed, whereby the spool takes up the donor web at a rate slower than that at which the web is payed-out of the print zone. By this arrangement. the take-up spool exerts zero tension on the web during the printing operation, and certain tension-produced artifacts in the thermal print are eliminated. During the interval between successive printing operations, the take-up spool is rotated at a rate sufficient to take-up the web slack produced during printing.

8 Claims, 2 Drawing Sheets

THERMAL PRINTING APPARATUS WITH TENSIONLESS DONOR WEB DURING PRINTING

BACKGROUND OF THE INVENTION

The present invention relates to the field of thermal printing. More particularly, it addresses the technical task of eliminating certain artifacts appearing in thermal prints as a result of variations in the tension of a dye-bearing donor web during the printing operation.

In the thermal printing process, a dye-bearing donor web is brought into contact with a dye-receiving print media at a print zone. Thermal printing is effected by contacting the donor web with a multi-element print head which spans the donor web in a direction transverse to the direction of web travel. The print head typically comprises a linear array of closely spaced resistive elements, each being independently addressable by an applied voltage to heat that portion of the donor web directly opposite and thereby cause dye to transfer from the donor web to the print media. To maintain intimate contact between the donor web and print media during this printing operation, the donor web and print media are partially wrapped over the surface of a rotatably-driven platen roller, sometimes referred to as a "transfer drum". The transfer drum is usually driven by a precision stepper motor so that the drum may be stopped at precise locations for printing a line of information on the print media. Most often, the take-up spool is rotatably driven by a far less-expensive DC motor, since its function is simply to accumulate expended donor web. The donor web is supplied by a rotatably mounted supply spool, and a clutching arrangement is used to control the drag on the web by the supply spool so as to prevent free-wheeling of the supply spool under the influence of the take-up spool motor.

In thermal printing apparatus of the above type, it has been observed that the print quality is influenced considerably by the tension in the donor web during printing. When web-tension varies during printing, an artifact known as "banding" appears in the thermal print. This artifact is particularly noticeable when the nominal donor web tension is high, as is ordinarily the case when the take-up spool has not yet accumulated a significant amount of donor web and, hence, the diameter of the wound-up web spool is small. Ideally, the web tension exerted by the take-up spool should be maintained uniform throughout the printing cycle. Unfortunately, however, this ideal is very difficult to achieve, especially when relatively low-cost drive motors are used to effect take-up spool rotation. Web tension is also known to vary with the load applied by the print head, and the drag action of the web supply spool. Also, the relative diameters of the supply and take-up spools have a variable effect on web tension. As prints are made, these spool diameters change, thereby altering the web tension.

In U.S. Pat. No. 4,642,656 issued to Shibaya et al., there is disclosed a thermal printer having a print head which is movable between a printing position in which it contacts the donor web at a print zone, and a non-printing position in which it is spaced from the donor web. According to this disclosure, the torque transmitted to the take-up spool is determined by the position of the thermal print head. When the print head is in its printing position, i.e. contacting the donor web, the transmitted torque to the take-up spool is smaller than that when the print head is in a non-printing position, spaced from the donor web. The apparent intent, here, is to maintain lesser tension on the donor web during printing than during the intervals between prints. While this approach may minimize certain web-tearing problems which may occur when a uniformly high tension is always applied to the web, it does not eliminate the "banding" artifacts which will still appear in the thermal print in the case of web tension variations about a low-tension level.

SUMMARY OF THE INVENTION

An object of this invention is to eliminate the variable web-tension-produced artifacts in prints produced by thermal printing apparatus of the above type.

According to the inventive concept, the tension in the donor web produced by a rotatably driven take-up spool is reduced to zero during the printing operation. This tensionless condition is achieved by rotating the take-up spool at a rate slower than the rate at which the donor web is payed-out from the print zone. To eliminate the web slack which inherently results from rotating the take-up spool at a rate which is insufficient to accumulate the web payed-out of the print zone, the take-up spool is rotated at a relatively high rotational rate during the intervals between printing cycles when the thermal print head is spaced from the donor web. Preferably, a two-speed motor is used to rotate the take-up spool at two different rates, i.e. a rate sufficiently slow as to produce, during each printing cycle, web slack between the print zone and the take-up spool, and a rate sufficiently fast as to eliminate all web slack between printing cycles. According to another embodiment, slack-sensing means are provided for sensing the web slack and for controlling the take-up spool motor speed accordingly.

The invention and its advantages will be better understood from the ensuing detailed description of preferred embodiments, reference being made to the accompanying drawings.

DETAILED DESCRIPTION OF PREFERRED EMBODIMENTS

Figure 1:
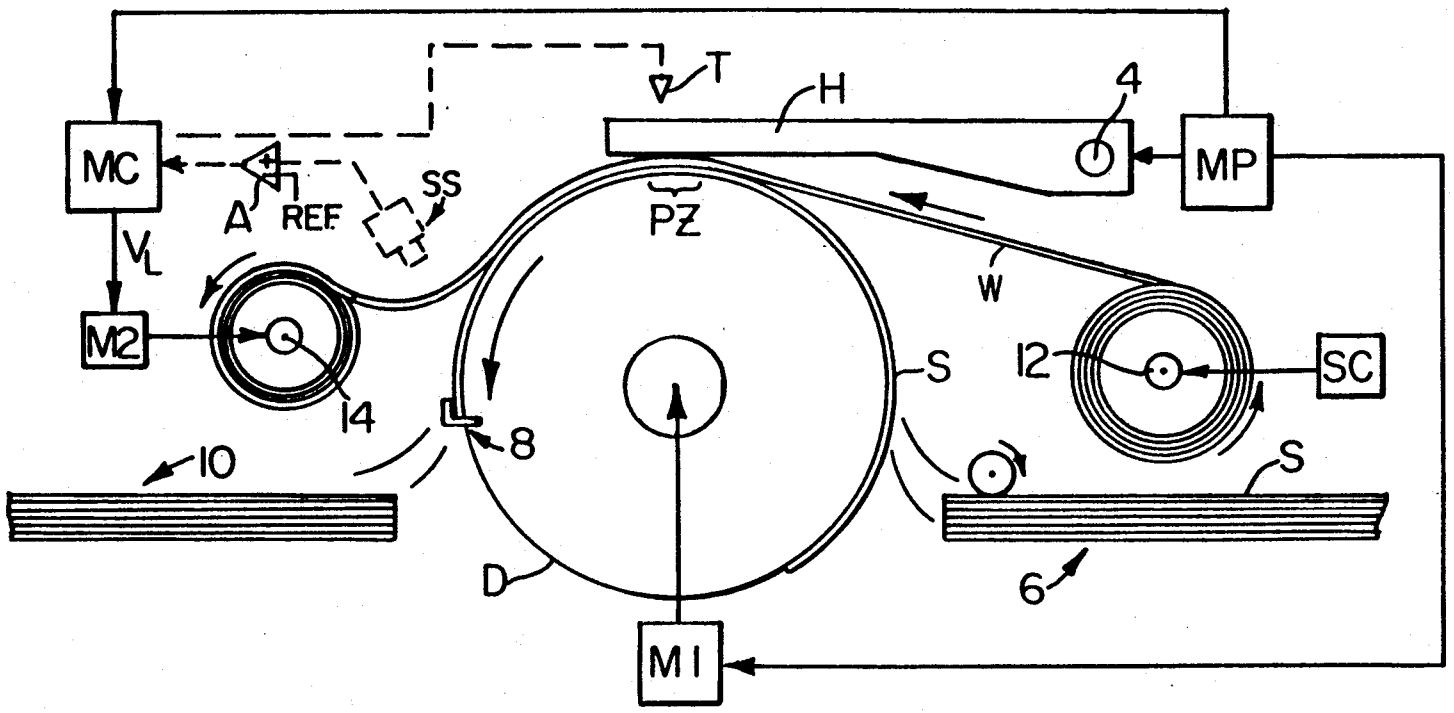
FIGS. 1 and 2 are schematic illustrations of a thermal printer embodying the invention.
Figure 2:
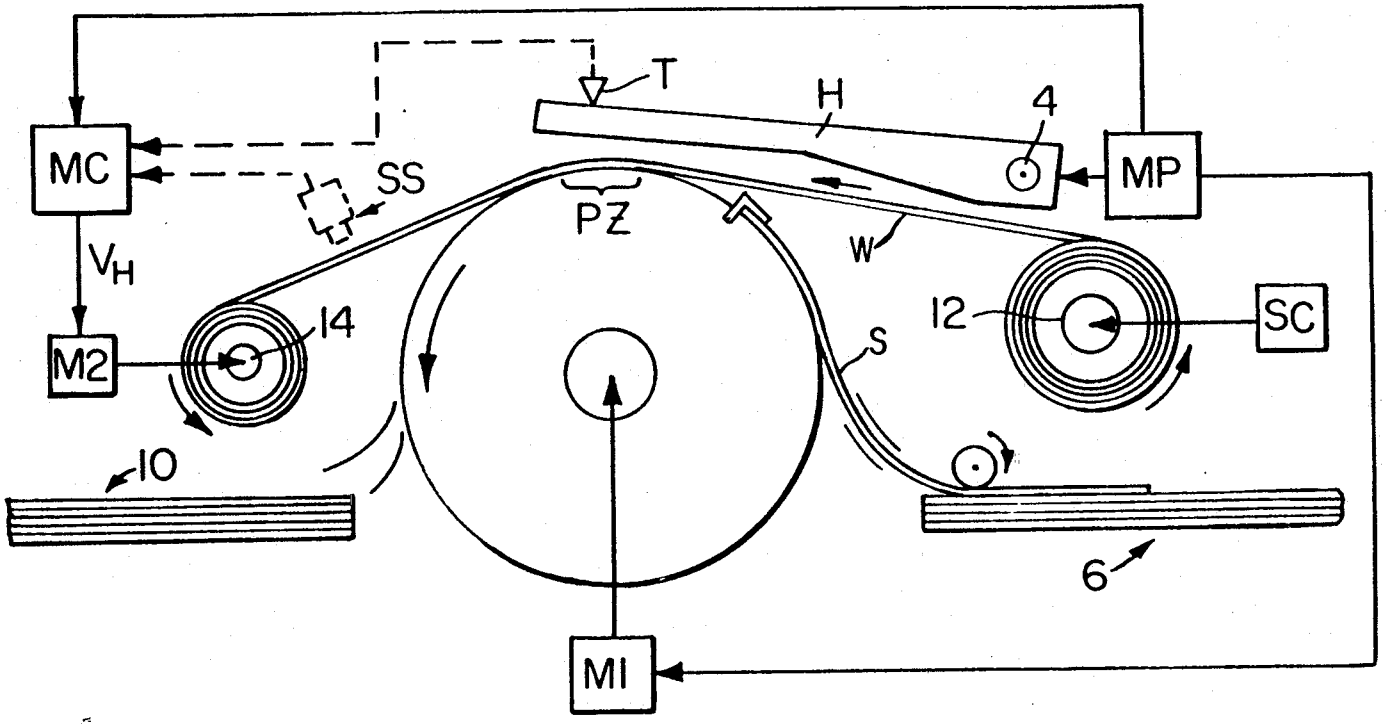

Referring now to the drawings, FIGS. 1 and 2 schematically illustrate a thermal printer embodying the present invention. Such printer generally comprises a cylindrical print drum D which functions to support and transport a print-receiver sheet S through a print zone PZ where it receives thermally printed information. Thermal printing is effected by advancing a dye-bearing donor web W through the print zone between the print-receiver sheet and a thermal print head H. The print head is movably mounted, e.g., for pivotal movement about a pivot pin 4, for movement between a print position (shown in FIG. 1) in which it presses against the print drum and the media therebetween, and a non-printing position (shown in FIG. 2) in which the print head is spaced from the print drum.

Print head H spans the print drum and is of conventional design, comprising a linear array of closely spaced resistive elements, each being independently addressable with image information by an applied voltage provided by a microprocessor MP. As each resistive element is addressed, it heats that portion of the donor web directly opposite, thereby causing dye to transfer from the donor web to the print-receiver sheet. In color thermal printers, the donor web usually comprises patches of cyan, yellow and magenta dyes in a repeating series, and the print-receiver sheet is rotated three times through the print zone to receive a full-color image. The print-receiver sheets are fed to the drum from a sheet supply 6 and are clamped to the drum by a suitable clamping mechanism 8, e.g., disclosed in U.S. Pat. No. 4,815,870. Upon receiving the thermal image, the clamping mechanism releases the print-receiver sheet, allowing it to enter an output tray 10.

Print drum D is rotatably driven by a precision stopper motor M1 which, in turn, is controlled by the output of the microprocessor. The microprocessor also functions to control the position of the print head so as to move the head to its non-printing position to allow passage of the clamping mechanism through the print zone, as well as portions of the drum not bearing a print-receiver sheet.

The dye-bearing donor web W is fed through the print zone from a supply spool 12 to a take-up spool 14. Rotation of the take-up spool is effected by a motor M2. As noted above, it has been observed that whenever tension is applied to the donor web by the supply spool during the printing operation, there is a tendency for the "banding" artifact to appear in the printed image. Such banding is evidenced by high spatial frequency variations in density of the printed image, and is particularly noticeable in solid tones. The banding artifact is particularly noticeable when the web is under high tension, such as occurs at the beginning of the print-making process, when the take-up spool diameter is small relative to the supply spool.

Now in accordance with the present invention, the above-noted banding artifact is substantially reduced by producing a zero-tension condition in the donor web during the printing operation. During the printing operation, the donor web is advanced through the printing zone only by the movement of the print drum and by the frictional engagement between the print head and the moving print-receiver sheet clamped to the drum. That is, during printing, movement of the donor web is not assisted by any tension on the web produced by take-up spool 14. According to the invention, the take-up spool is, during printing, rotated at a rate equal to or, preferably, slower than the rate at which the donor web is payed-out of the print zone by the rotating print drum. As shown in FIG. 1, during the printing operation, the web becomes slack in a direction downstream of the print zone, between the print zone and take-up spool 14. As soon as printing is completed and the print head is moved to its non-printing position, the take-up spool 14 is rotated at a faster rate, a rate sufficient to take up the slack in the donor web produced during the printing operation. As shown in FIG. 2, just prior to (or after) a printing operation, the print head H is in its non-printing position and the take-up motor M2 is driving the take-up roller at a rate sufficient to eliminate any slack in the web. A conventional slip-clutch SC connected to the supply spool 12 serves to provide a drag on the supply spool sufficient to prevent any substantial free-wheeling of the supply spool during both printing and non-printing cycles. Such drag, of course, is not sufficient to produce any substantial tension in the web while the web is being advanced only by the rotation of the print drum.

According to a preferred embodiment, the take-up spool motor M2 is a two-speed motor which responds to two different voltages, shown for the sake of illustration, as a high voltage $V_H$ and a low voltage $V_L$. The two voltages applied to motor M2 are provided by a motor control circuit MC which responds to an output provided by the microprocessor indicating whether or not the print head is in its printing position. Alternatively, the motor control circuit can respond to the output of a suitable transducer T, positioned to be physically contacted by the print head as it moves from a printing to a non-printing position. Also, the motor control circuit could respond to a photoelectric or capacitance-type slack sensor SS which would provide an output signal proportional to the spacing between the sensor and the donor web; in this case, the output from the motor control circuit would be continuously compared to a reference value in a differential amplifier A, and the amplifier output would be frequently switched between high and low voltages to maintain desired the slack condition during printing.

The invention has been described in detail with particular reference to a certain preferred embodiment thereof, but it will be understood that variations and modifications can be effected within the spirit and scope of the invention.

What is claimed is:

1. Thermal printing apparatus comprising:

a dye-bearing donor web extending between rotatably mounted supply and take-up spools;

a rotatably mounted print drum having an arcuate surface for guiding and supporting said web for movement along an arcuate path;

first motor means for rotating said drum;

second motor means for rotating said take-up spool at a rotational speed;

a thermal print head positioned along said arcuate path, said head being mounted for movement between a non-printing position spaced from said path and a printing position contacting said web on said drum at a print zone;

print head control means for controlling the movement of said print head between its non-printing and printing positions;

means for advancing print-receiving media between said web and said drum at said print zone, said print head being electrically addressable to print information on said media by selectively transferring dye from said donor web to said media at said print zone; and motor control means for controlling said second motor means for variably controlling the rotational speed of said take-up spool so that, (a) when said print head is in its printing position and said web is being payed-out from said print zone at a rate, said take-up spool takes up donor web at a rate slower than the rate at which said web is payed-out from said print zone, whereby slack is produced in said web between said print zone and said take-up spool during a print cycle, and (b) when said print head is in its non-printing position, said take-up spool takes up donor web at a rate sufficient to substantially eliminate any slack in said web produced between said print zone and said take-up spool during such print cycle.

2. The apparatus as defined by claim 1 wherein said second motor means comprises a two-speed motor for rotatably driving said take-up spool, and wherein said motor control means comprises means responsive to the print head position for supplying either of two voltages to said two-speed motor to operate said motor at either of two different rotational speeds.

3. The apparatus as defined by claim 2 further comprising means for sensing a slack condition in said web between said print zone and said take-up spool and for producing an output signal indicative of such slack condition, said motor control means being responsive to said signal for controlling the speed of said two-speed motor.

4. A method for printing information on a print-receiving media at a print zone, said method comprising the steps of:

(a) contacting a portion of said media with a portion of a dye-containing web;

(b) advancing said contacting portions of said media and web through said print zone at a predetermined rate;

(c) selectively transferring dye from said web to said media at said print zone to record information on said media; and (d) maintaining that portion of the web downstream of said print zone in a tensionless condition while information is printed on said media.

5. The method according to claim 4 further comprising the step of accumulating the web on a take-up spool while information is printed on said media, said accumulation step being affected at a rate slower than said predetermined rate, whereby slack is produced in said web during the printing of information on said media.

6. The method according to claim 5 further comprising the step of accumulating the web on a take-up spool, when no information is being printed on said media, at a rate sufficient to eliminate any slack in said web.

7. A method for producing thermal prints comprising:

(a) unwinding a dye-bearing donor web from a rotating supply spool and advancing such donor web to a print zone at which such web is acted upon by a thermal print head and a print drum driven by a first motor to imagewise transfer dye from the web to a print-receiving medium;

(b) advancing such donor web from the print zone at a constant velocity toward a rotatably-mounted take-up spool rotatable at a rotational speed;

(c) winding-up the donor web on the take-up spool by rotatably driving the take-up spool by a second motor; and (d) controlling the rotational speed of the take-up spool so that, while dye is being transferred to the print medium at the print zone, the web is wound upon the take-up spool at a rate slower than said constant velocity.

8. Thermal printing apparatus comprising:

(a) a supply spool having thereon a dye-bearing donor web;

(b) means for rotatably supporting said supply spool;

(c) a rotatably-driven print drum for unwinding said web from said supply spool and for advancing said web past a thermal print head at a print zone where dye is imagewise transferred to a print-receiving medium by said print head, said rotatably-driven print drum causing said supply spool to rotate as it unwinds web therefrom and further causing the web to be paid-out of the print zone at a constant rate;

(d) a rotatably-mounted take-up spool for accumulating web paid-out of said print zone; and (e) variable-speed motor means for rotating said take-up spool at a variable rate such that, during printing, the take-up spool accumulates the donor web slower than the constant rate at which the donor web is paid-out of said print zone.

* * * * *